United States Patent [19]

Muroi et al.

[11] Patent Number: 4,858,928

[45] Date of Patent: Aug. 22, 1989

[54] RACKET FRAME

[75] Inventors: Kunimasa Muroi; Yoshinari Inagaki; Tetsuyuki Awano, all of Hamamatsu, Japan

[73] Assignee: Yamaha Corporation, Japan

[21] Appl. No.: 55,000

[22] Filed: May 28, 1987

[30] Foreign Application Priority Data

Jun. 10, 1986 [JP] Japan ..... 61-88390[U]
Jul. 9, 1986 [JP] Japan ..... 61-105240[U]
Nov. 20, 1986 [JP] Japan ..... 61-178491[U]

[51] Int. Cl.[4] ..... A63B 49/04
[52] U.S. Cl. ..... 273/73 D; 273/73 C
[58] Field of Search ..... 273/73 D, 73 L, 73 C, 273/73 F, 73 H, 73 K

[56] References Cited

U.S. PATENT DOCUMENTS 3,625,512 12/1971 Latham ..... 273/73 C
3,913,911 10/1975 Peterson ..... 273/73 C

FOREIGN PATENT DOCUMENTS 902428 2/1985 Belgium ..... 273/73 C
0219310 10/1986 European Pat. Off. ..... 273/73 D

*Primary Examiner*—Edward M. Coven
*Assistant Examiner*—William E. Stoll
*Attorney, Agent, or Firm*—Lerner, David, Littenberg, Krumholz & Mentlik

[57] ABSTRACT

In construction of a racket frame provided with at least one string protector coupled to the outer peripheral surface of its head, at least one weight adjusting element is removably attached to the outer peripheral surface of the string protector for easy weight adjustment by users even after formation of a face in tension.

3 Claims, 5 Drawing Sheets

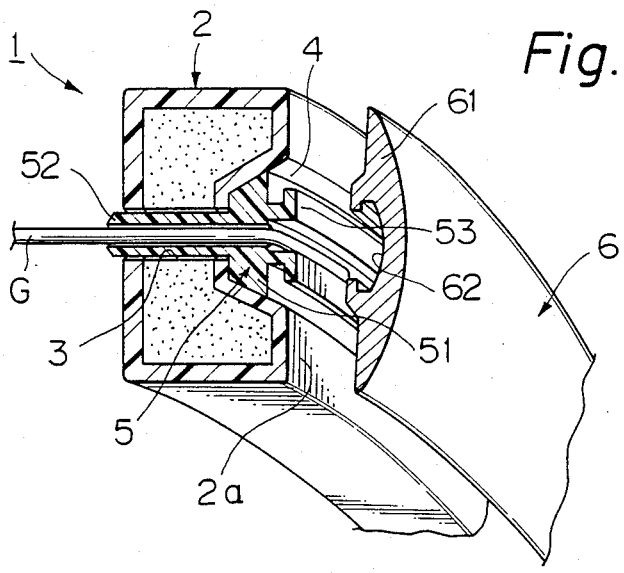
Fig. 3
Fig. 4
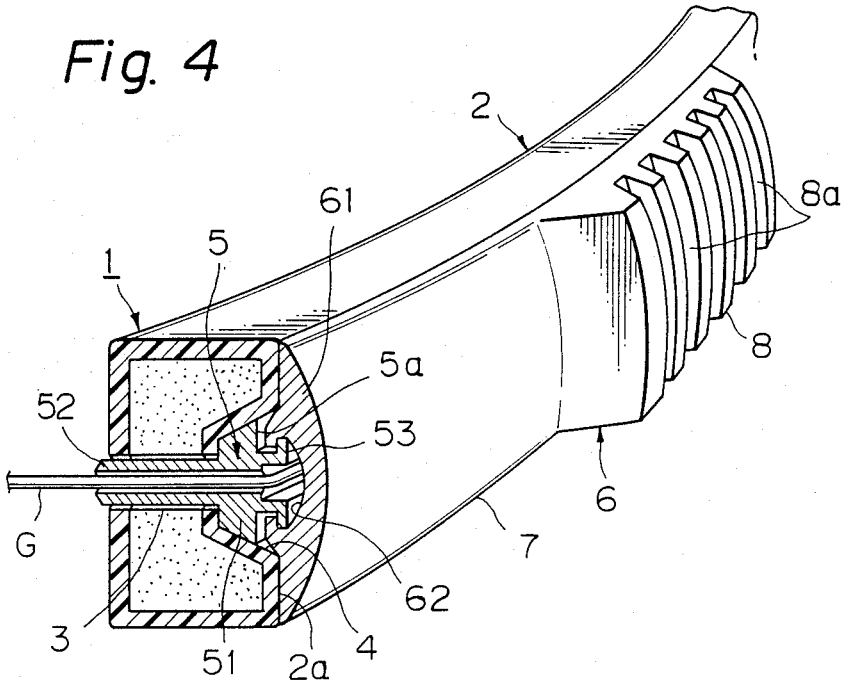

RACKET FRAME

BACKGROUND OF THE INVENTION

The present invention relates to an improved racket frame, and more particularly relates to improvement in weight adjustability of a racket frame provided with string protectors attached to its head.

The head of a racket frame is generally oval in shape and has two main axes normal to each other. That is, a longitudinal axis is an extension of the longitudinal axis of the grip and passes through the center of the oval head. A lateral axis is normal to the longitudinal axis and also passes through the center of the oval head.

In general, proper different weight adjustment is applied to racket frames on market depending on the degree of skill of users.

Such weight adjustment is usually achieved during production by embedding a weight adjusting element or elements into the head or the grip. In some cases, they are secured to the head or the grip by bonding. Weight adjustment is also attained by properly designing weight balance before production.

Such weight adjustment at the stage of or before production does not allow free and subtle weight adjustment by users depending on the degree of personal skill. In addition, when secured by bonding, the weight adjusting elements are apt to fall during usage of racket frames. Such unexpected separation not only endangers users by also degrades the appearance of the racket frames.

Japanese patent application No. sho. 59-134514 proposes a new way of weight adjustment. Several weight adjusting elements, each including a band type substrate, are locally attached to the outer peripheral surface of the head of a racket frame and each weight adjusting element is held firm at the position of attachment by a string extending in tension between adjacent string holes in the head.

The above-described substrate is formed in one body with associated tubular string protectors inserted into the adjacent string holes. At formation of the face in tension at shops, the weight adjusting element is cut to a length depending on the personal preference of each user, attached to the outer peripheral surface of the head with the associated string protectors being inserted into adjacent string holes, and fixed to the position of attachment by a string extending in tension between the adjacent string holes.

There is sold in market a type of tennis racket in which string protectors solely or accompanied with a string protector band are already attached over the entire outer peripheral surface of the head during production. When the above-described new proposal is to be applied to a tennis racket of this type, the protector band has to be removed at positions of attachment of the weight adjusting elements. In addition, this proposed new way also does not allow free and subtle weight adjustment by users after formation of the face in tension.

Further, when the weight adjusting elements, each including the band type substrate, are attached to the opposite lateral sections of the head astride the lateral axis, it is necessary to displace the weight adjusting element circumferentially on the outer peripheral surface of the head for weight balance adjustment. It is also necessary to prepare weight adjusting elements of different weights, i.e. thicknesses.

SUMMARY OF THE INVENTION

It is the object of the present invention to provide a racket frame which allows free and subtle weight adjustment by users even after formation of the face in tension.

In accordance with the present invention, at least one weight adjusting element is removably coupled to at least one string protector which extends on the outer peripheral surface of the head between adjacent string holes.

BRIEF DESCRIPTION OF THE DRAWINGS

FIG. 3 is a sectional perspective view of the racket frame shown in FIG. 2 in a disassembled state, FIG. 4 is a sectional perspective view of another embodiment of the present invention.

DESCRIPTION OF THE PREFERRED EMBODIMENTS

Figure 1:
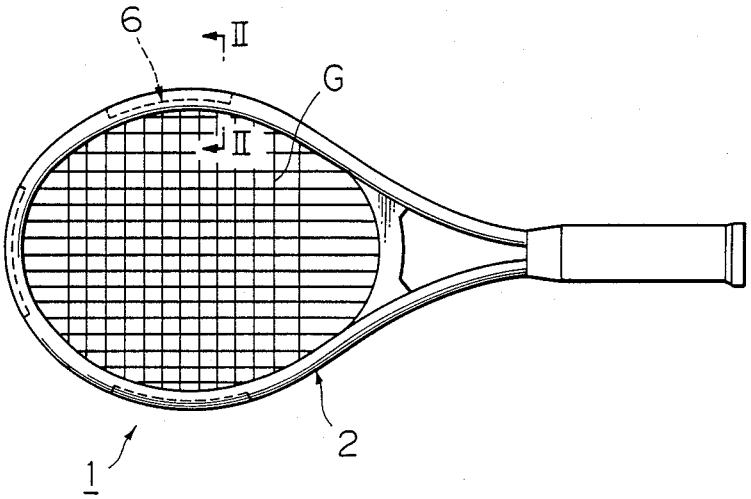
FIG. 1 is a plan view of a racket frame to which the present invention is applied.

One embodiment of the present invention is shown in FIG. 1, in which a racket frame 1 made of, for example, FRP has an oval head 2 holding in tension a face made of interlaced strings G. A number of string holes 3 are formed through the head 2.

Figure 2:
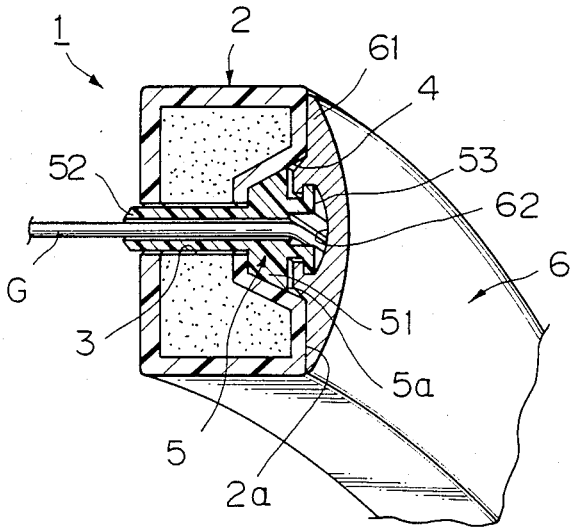
FIG. 2 is a sectional perspective view of one embodiment of the present invention taken along a line II—II in FIG. 1.

As shown in FIGS. 2 and 3, a circumferential groove 4 is formed in the outer peripheral surface 2*a* of the head 2 over the entire length of the latter and a string protector 5 is placed in the circumferential groove 4 in the region between adjacent string holes 3. The string protector 5 is made of synthetic resin and monolithically comprised of a protector band 51 and protector tubes 52 to be inserted into the string holes 3 in the head 2. The string protector 5 is placed in the circumferential groove 4 during production of the racket frame or formation of the face. The protector tube 52 receives an associated string G. A substantially T-shaped locker rail 53 is monolithically formed on the outer peripheral surface 5*a* of the string protector 5 in the circumferential direction of the racket frame 1. A locker rail 53 may extend over the entire length of the head 2 or several locker rails may be locally distributed over the entire length of the head 2. One or more weight adjusting elements 6 of proper length are attached to the locker rail 53 of the string protector 5.

An elongated weight adjusting element 6 includes a band type substrate 61 which is provided in its inner surface with an elongated recess 62 engageable with the locker rail 53 on the outer surface 5*a* of the string protector 5. The outer surface of the substrate 61 is shaped round in order to reduce air resistance when attached to the head 2. The width of the substrate 61 is close to that of the outer peripheral surface 2a of the head 2 in order to fully cover the outer peripheral surface 2a including the circumferential groove 4 for better appearance.

Since the weight adjusting element of the present invention is removably coupled to the outer peripheral surface of the string protector via the locker rail, weight adjustment can be carried out very easily by users even after formation of the face in tension. Coverage of the outer peripheral surface of the head including the circumferential groove much improves the appearance of the racket frame and reduces air resistance during usage.

Figure 5:
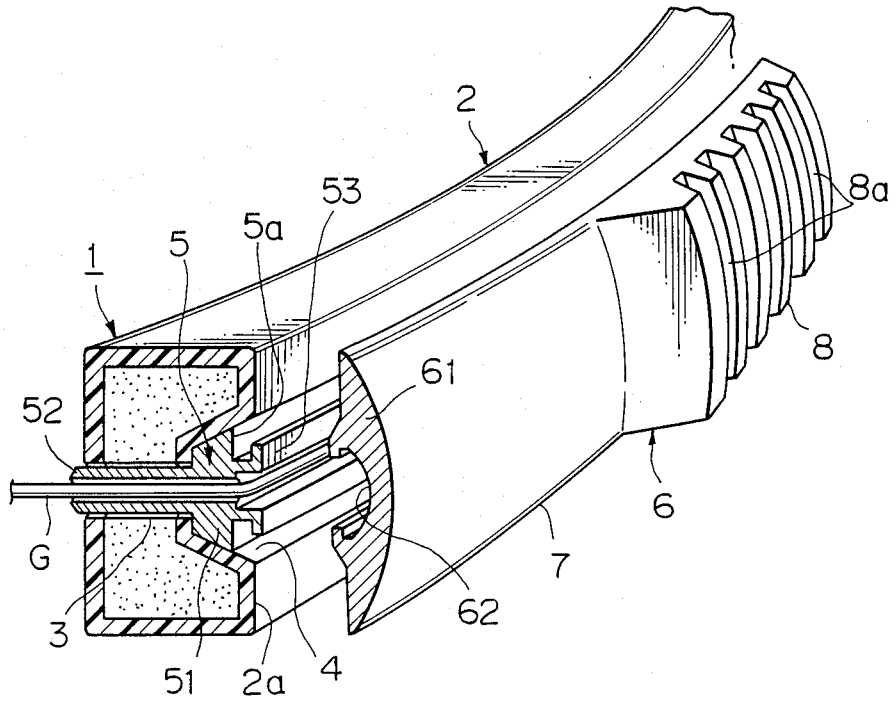
FIG. 5 is a sectional perspective view of the racket frame shown in FIG. 4 in a disassembled state.

Another embodiment of the racket frame 1 in accordance with the present invention is shown in FIGS. 4 and 5. Like the forgoing embodiment, a weight adjusting element 6 is coupled to the outer peripheral surface 5a of the string protector 5 via the locker rail 53. This weight adjusting element 6 includes a band type substrate 61 which is made up of a thin section 7 and a thick section 8 of a substantially same length. Thus a biased weight distribution is obtained over the entire length of the head 2. A number of transverse nicks 8a are formed side by side in the thick section 8 so that the section 8 should well follow the curvature of the oval head 2.

When it is wanted to make the longitudinal section astride the longitudinal axis opposite to the grip heavier than other sections of the head 2, the weight adjusting element 6 is coupled to the string protector 5 with its thin section 7 being located close to the grip. Whereas, when it is wanted to make the grip side longitudinal section heavier than other sections of the head 2, the thick section 8 of the weight adjusting element 6 is located near the grip. By simply reversing the coupling direction of the weight adjusting element 6, not only weight adjustment but also weight balance adjustment along the longitudinal axis of the head can be carried out.

As a substitute for the difference in thickness, density of the material forming the weight adjusting element 6 may be varied along its length in order to have biased weight distribution. As a further substitute, one or more mass pieces may be locally embedded in the weight adjusting element 6.

In the case of the foregoing embodiments, the locker rail 53 on the string protector 5 and the elongated recess 62 in the weight adjusting element 6 both have uniform widths over their entire lengths. Due to such uniformity in width, shock at striking balls and/or centrifugal force at swing of the racket frame is liable to cause slight displacement of the weight adjusting element 6 from the initial set position. Although such a movement may be prevented by raising production precision of the locker rail 53 and the elongated recess 62, too tight engagement between them disenables intended movement of the weight adjusting element 6 by users.

The other embodiments of the racket frame in accordance of the present invention shown in FIGS. 6 to 10 are proposed in order to prevent the unexpected slight movement but allow the intended movement of the weight adjusting element.

Figure 6:
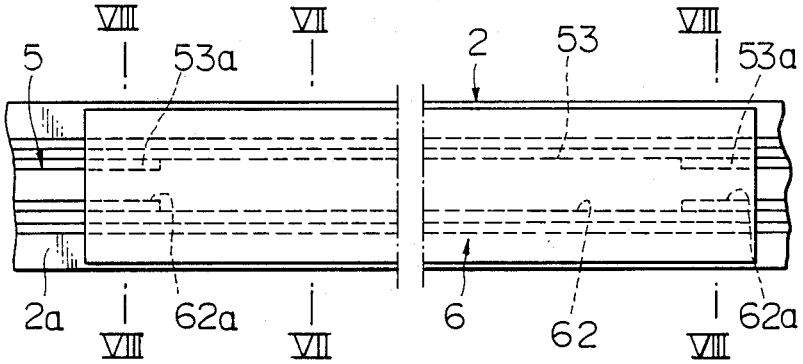
FIG. 6 is a plan view of the other embodiment of the present invention.
Figure 7:
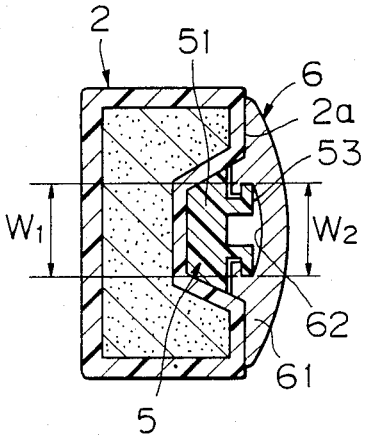
FIG. 7 is a sectional view taken along a line VII—VII in FIG. 6.
Figure 8:
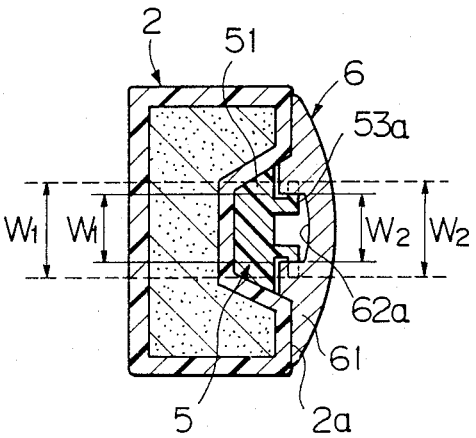
FIG. 8 is a sectional view taken along lines VIII—VIII in FIG. 6.

As shown in FIGS. 6 to 8, the width W1 of the locker rail 53 and the elongated recess 62 in the end areas 53a and 52a of the engagement is smaller than their width W2 in the middle area of the engagement. Due to such local difference in width, the weight adjusting element 6 can be firmly held at the initial set position despite shock at stricking balls and/or centrifugal force at swing of the racket frame.

Figure 9:
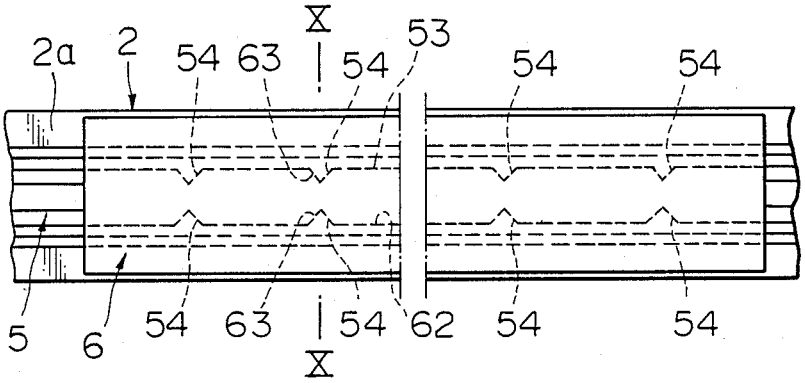
FIG. 9 is a plan view of a further embodiment of the present invention.
Figure 10:
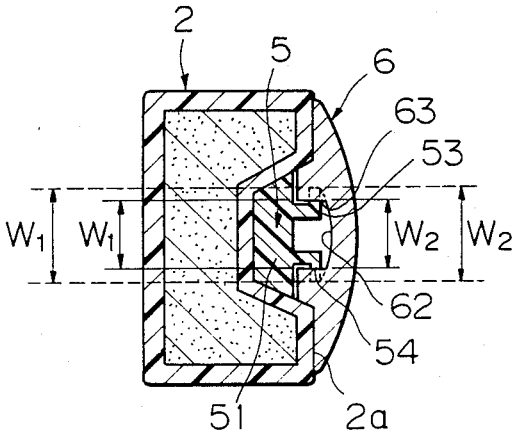
FIG. 10 is a sectional view taken along a line X—X in FIG. 9.

The other embodiment of the racket frame in accordance with the present invention is shown in FIGS. 9 and 10. In the case of this embodiment, the locker rail 53 on the string protector 5 has several, local side depressions 54. At corresponding positions in the engagement, the elongated recess 62 in the weight adjusting element 6 has corresponding number of local side projections 63 to be received in the corresponding local side depressions 54 in the locker rail 53. Conversely, such local side depressions may be formed in the elongated recess 62 with the corresponding local, side projections being formed on the locker rail.

We claim:

1. A racket frame comprising a grip, a head coupled to one end of said grip, said head including a peripheral surface, a plurality of string holes extending through said peripheral surface, and a circumferential groove extending along said peripheral surface, at least one string protector extending within said circumferential groove between adjacent ones of said plurality of string holes, said string protector including an outer peripheral surface and an integral locker rail projecting from said outer peripheral surface, said locker rail including transversely extending locker arm means, said transversely extending locker arm means including a first portion and a second portion, said first and second portions extending transversely first and second distances, said first and second distances differing from each other, and at least one longitudinally extending weight adjusting element including an inner surface and an outer surface, said inner surface of said at least one weight adjusting element including elongated recess means formed therein and transversely extending arm members tightly engageable with said transversely extending locker arm means on said string protector whereby said at least one weight adjusting element can be removably coupled to said outer peripheral surface of said string protector.

2. The racket frame of claim 1 wherein said first portion of said transversely extending locker arm means comprises the center of said transversely extending locker arm means, and said second portion of said transversely extending locker arm means comprises the end sections of said transversely extending locker arm means.

3. A racket frame comprising a grip, a head coupled to one end of said grip, said head including a peripheral surface, a plurality of string holes extending through said peripheral surface, and a circumferential groove extending along said peripheral surface, at least one string protector extending within said circumferential groove between adjacent ones of said plurality of string holes, said string protector including an outer peripheral surface and an integral locker rail projecting from said outer peripheral surface, said locker rail including transversely extending locker arm means, said transversely extending locker arm means including a first portion and a second portion, said first and second portions extending transversely first and second distances, said first and second distances differing from each other, and at least one longitudinally extending weight adjusting element including an inner surface and an outer surface, said inner surface of said at least one weight adjusting element including elongated recess means formed therein and transversely extending arm members tightly engageable with said transversely extending locker arm means on said string protector, said transversely extending arm members including first and second portions, said first and second portions extending transversely first and second distances, said first and second distances differing from each other whereby said at least one weight adjusting element can be removably coupled to said outer peripheral surface of said string protector.

* * * * *

UNITED STATES PATENT AND TRADEMARK OFFICE

CERTIFICATE OF CORRECTION

PATENT NO. : 4,858,928

DATED : August 22, 1989

INVENTOR(S) : Muroi *et al*

It is certified that error appears in the above-identified patent and that said Letters Patent is hereby corrected as shown below:

Column 1, line 45, after "tension" insert --on the head--.

Signed and Sealed this

Fourth Day of September, 1990

*Attest:*

HARRY F. MANBECK, JR.

*Attesting Officer*

*Commissioner of Patents and Trademarks*